United States Patent [19]

Donachie et al.

[11] Patent Number: 4,600,556

[45] Date of Patent: Jul. 15, 1986

[54] DISPERSION STRENGTHENED MECHANICALLY ALLOYED AL-MG-LI

[75] Inventors: Stephen J. Donachie, New Windsor; Paul S. Gilman, Suffern, both of N.Y.

[73] Assignee: Inco Alloys International, Inc., Huntington, W. Va.

[21] Appl. No.: 521,060

[22] Filed: Aug. 8, 1983

[51] Int. Cl.[4] ..... C22C 21/00

[52] U.S. Cl. ..... 420/542; 148/12.7 A; 148/415

[58] Field of Search ..... 148/12.7 A, 415; 420/542

[56] References Cited

U.S. PATENT DOCUMENTS

| | | |
|---|---|---|
| 3,333,989 | 8/1967 | Brown et al. . |
| 3,591,362 | 7/1971 | Benjamin . |
| 3,740,210 | 6/1973 | Bomford et al. . |
| 3,792,997 | 2/1974 | Storchheim . |
| 3,816,080 | 6/1974 | Bomford et al. . |
| 3,826,688 | 7/1974 | Levy . |
| 4,292,079 | 9/1981 | Pickens et al. . |
| 4,297,136 | 10/1981 | Pickens et al. . |
| 4,409,038 | 10/1983 | Weber . |

FOREIGN PATENT DOCUMENTS

| | | |
|---|---|---|
| 1482777 | 8/1977 | United Kingdom . |

OTHER PUBLICATIONS

D. L. Erich and S. J. Donachie, "Benefits of Mechanically Alloyed Aluminum", Metal Progress, vol. 121, No. 2, Feb. 1982, pp. 22–25.

K. Dinsdale et al, "Relationship Between Microstructure and Mechanical Properties of Aluminum–Lithium–Magnesium Alloys", in Proceedings of the First International Aluminum–Lithium Conference sponsored by the TMS–AIME Nonferrous Metals Committee at Stone Mountain, Georgia, May 19–21, 1980, pp. 101–118, 1981.

*Primary Examiner*—R. Dean

*Attorney, Agent, or Firm*—Miriam W. Leff; Raymond J. Kenny

[57] ABSTRACT

A dispersion strengthened mechanically alloyed aluminum-base alloy system is provided by a process comprising solution treating an alloy consisting essentially of, by weight, about 0.5 up to about 4% lithium, above 1% up to about 5% magnesium, about 0.5% up to about 2% carbon, a small but effective amount of oxygen which does not exceed 1%, and the balance essentially aluminum, the dispersoid content of the alloy being up to about 8 volume %. Preferred embodiments of the alloy are in the solution treated or solution treated and underaged condition are characterized by an improved combination of strength, low density, ductility, and fracture toughness.

30 Claims, No Drawings

DISPERSION STRENGTHENED MECHANICALLY ALLOYED AL-MG-LI

TECHNICAL FIELD

The present invention relates to dispersion-strengthened aluminum, and more particularly, to mechanically alloyed aluminum-magnesium-lithium alloy powders and consolidated products made therefrom.

BACKGROUND OF THE INVENTION

Considerable research efforts have been made to develop high strength aluminum which would satisfy the demands of advanced design in aircraft, automotive and electrical industries. Aluminum-lithium alloys are amongst those under consideration because of the potential that the addition of lithium to aluminum offers for improving properties of aluminum with respect to density and elastic modulus. However, the improvement of one or even two properties does not mean the alloy will be useful for certain advanced design applications. Rather, for the alloy to be useful, it must meet all minimum target property requirements. Such properties as density, strength, ductility, toughness, fatigue and corrosion resistance, are among the properties considered.

Heretofore, many aluminum-lithium alloy systems prepared by ingot metallurgy techniques have been studied. Also, various aluminum-lithium, aluminum magnesium and aluminum-copper-magnesium systems which have been prepared by mechanical alloying techniques, have been studied. However, none have been entirely satisfactory for certain applications which require low density, high strength, corrosion resistance, fracture toughness and good ductility. Fracture toughness is a measure of the ability of a material to tolerate a flaw, i.e., a crack, without fracturing. The terms "toughness" and "fracture toughness" are used herein interchangeably.

The mechanical alloying technique has been disclosed, for example, in U.S. Pat. Nos. 3,591,362; 3,740,210; and 3,816,080. Mechanical alloying, as described in the aforesaid patents, is a method for producing composite metal powders with a controlled, uniform fine microstructure. It occurs by the fracturing and rewelding of a mixture of powder particles during high energy impact milling in a controlled environment, e.g. in an attritor grinding mill, in the presence of a process control agent. In the process, dispersoid materials such as, for example, the naturally occurring oxide on the surface of powder particles are incorporated into the interior of the composite powder particles and homogeneously dispersed therethrough. In a similar fashion, metallic alloy ingredients are also finely distributed within the powder particles. The powders produced by mechanical alloying are subsequently consolidated into bulk forms by various methods such as hot compaction followed by extrusion, rolling or forging.

A major problem with many conventional aluminum-lithium alloys is that when they meet requirements of density and strength, they are not sufficiently ductile or tough to be useful. In accordance with the present invention, alloys are provided which have ductility as well as a combination of low density, high strength and fracture toughness.

BRIEF DESCRIPTION OF THE INVENTION

In accordance with the present invention, a dispersion-strengthened mechanically alloyed aluminum-base alloy system is provided which is characterized in the solution treated condition by improved strength, fracture toughness and ductility, the low density, said alloy system is comprised essentially of aluminum, magnesium, carbon and oxygen, containing, by weight, about 0.5% to about 4% lithium, above 1% up to about 5% magnesium, a small but effective amount for increased strength up to about 2% carbon, a small but effective amount for thermal stability, up to 1% oxygen, and the balance being essentially aluminum, the dispersoid content of the alloy ranging up to about 8 volume %.

The alloy system is prepared by a process comprising: providing a mechanically alloyed dispersion strengthened powder comprised of aluminum, magnesium, lithium, carbon and oxygen, wherein the oxygen level is controlled so that in the consolidated alloy it will not exceed 1%, and preferably it is less than about 0.5%, degassing and consolidating the powder in a controlled time/temperature profile, solution treating the consolidated material to homogenize the structure and dissolve any precipitates formed on consolidation. The material may be aged. Preferably, it is treated to aging to below peak strength, i.e., it is underaged. If the alloy of the present invention is specified as being in the "solution treated condition", it is to be understood that the alloy is in a condition resulting from quenching after solution treatment.

In a preferred embodiment of the present invention, an alloy is provided in the solution treated or solution treated underaged condition and contains about 2 to about 4% magnesium, about 0.8 up to about 1.5% carbon, e.g. 1 to 1.2% carbon, and less than 0.5, e.g. 0.3 to 0.4% oxygen. This alloy, in the solution treated condition, will exhibit a combination of properties at room temperature of: tensile strength (UTSA) over 414 MPa (60 ksi) and even over 482 MPa (70 ksi); 0.2% yield strength (YS) at least 414 MPa (60 ksi); elongation of at least 7% and higher, e.g. 8% or 10%, fracture toughness ($K_Q$) of at least about 16.5 MPa $\sqrt{m}$ (15 ksi $\sqrt{in}$) and even higher than 27.5 MPa $\sqrt{m}$ (25 ksi $\sqrt{in}$).

DESCRIPTION OF EMBODIMENTS OF THE INVENTION

The essential components of the aluminum base alloy of the present invention are aluminum, magnesium, lithium, carbon and oxygen. The alloy is essentially copper-free. However, other elements may be incorporated in the alloy so long as they do not interfere with the desired properties of the alloy for a particular end use. Also, a minor amount of impurities may be picked up from the charge materials or in preparing the alloy. Additional insoluble, stable dispersoids or dispersoid forming agents may be incorporated in the system, e.g., for strengthening of the alloy at elevated temperatures, so long as they do not otherwise adversely affect the alloy.

The lithium is present in an amount of about 0.5 up to about 4%, advantageously in an amount of about 1 up to about 3% and more preferably from about 1.5 or 2 to about 2.5%. The magnesium level may range from above 1 up to about 5%, preferably it is about 2 up to about 4 or 4.5%. Exemplary alloys contain above 1.5 up to about 2.5% lithium and about 2 to about 4.5% magnesium.

Oxygen is present in a small but effective amount for increased strength and stability, e.g., about 0.05%, up to 1%, and preferably, it does not exceed about 0.4 or 0.5%. The low oxygen content is believed to be critical. When the oxygen content is above 1% the alloy is found to have poor ductility. In alloys containing above 1.5% Li, the oxygen content preferably does not exceed about 0.5%, and more preferably is lower than about 0.4%, e.g. lower than about 0.38%. In general the oxygen level is a measurement which is equivalent to the determination by the chemical analysis route given above. Carbon is present in a small but effective amount for strength, e.g. 0.05, up to about 2%, typically, about 0.5 to about 1.5 or 2%, preferably about 0.8 up to about 1.2%. In a preferred embodiment the carbon level exceeds the oxygen level and the ratio of carbon to oxygen is greater than about 2 to 1 and even greater than about 2.5 to 1. The oxygen level has been determined by inert gas fusion extraction, and the oxygen analysis is relative to this method.

The oxygen and carbon are, in general, present in the alloy as part of the dispersoid system, e.g., as oxides or carbides. In general, the alloy system included about 2% up to about 8% by volume (v/o) of finely divided, uniformly distributed dispersoid materials. Preferably, the dispersoid level is about 3 up to about 7 v/o, and more preferably about 4 up to about 6 or 7 v/o. In general the dispersoid level is as low as possible consistent with the required strength at the temperature at which the consolidated product will ultimately be used.

Typically, the dispersoid materials are oxides and carbides. For example, the disperoid particles can be formed during the mechanical alloying process, e.g., by control of the processing atmosphere and/or by using a process control agent. A process control agent is usually used in the mechanical alloying process and will usually contribute to the dispersoid content of the alloy. Examples of dispersoids that may be formed from aluminum and lithium components of the alloy are $Al_2O_3$, $Li_2O$, $Li_2AlO_4$, $LiAlO_2$, $LiAl_5O_8$, $Li_5AlO_4$, and $Al_4C_3$. Depending on components of the system, processing conditions and specific additives to obtain specific dispersoid, the dispersoid particle will vary. The disperoid species may include magnesium containing dispersoids, e.g., MgO. Intermetallic particles may also be present.

The formation of mechanically alloyed, dispersion strengthened aluminum-base alloys is given in detail in the aforementioned U.S. Patents. A method of thermomechanically treating aluminum-magnesium alloys produced from mechanically alloyed powder is given in U.S. Pat. No. 4,292,079, while U.S. application Ser. No. 174,181, U.S. Pat. No. 4,409,038 describes a method of producing solution-treated, aged aluminum-lithium alloy. The mechanically alloyed powder is formed by high energy milling, e.g., in an attritor using a ball to powder weight ratio of about 15:1 to 60:1 in the presence of a process control agent. The process control agent serves as a weld-controlling agent, but it may also serve as a dispersoid contributing agent, e.g., in the form of oxides and/or carbides. Suitable process control agents are, for example, graphite or a volatilizable oxygen-containing organic compound such as an organic acid, alcohol, aldehyde, ether, or a volatilizable hydrocarbon such as heptane. Preferred process control agents are methanol, stearic acid and graphite and combinations thereof. The oxygen and/or carbon content of the alloys may also be derived in whole or in part from the processing atmosphere. Alternatively, the dispersoid content may be incorporated, e.g., in part, as an additive in the alloy.

The mechanically alloyed powder is degassed and consolidated to a substantially dense body, these procedures being carried out at elevated temperatures. Optionally the consolidated product is hot or cold worked. Degassing and hot consolidation can be carried out at temperatures which are in the range of about 480° C. (895° F.) up to just below incipient liquification of the alloy. Preferably, degassing is carried out at a temperature of 510° C. (950° F.) up to 540° C. (1005° F.) and more preferably above 510° C., e.g., about 520° C. (970° F.). Hot consolidation is preferably at a temperature no higher than the degassing temperature in order to avoid damage to the material in the event the powder is not entirely degassed. The hot consolidated product may then be hot worked, e.g. by extrusion at a temperature in the range of about 315° C. (600° F.) to about 472° C. (800° F.), e.g. about 370° C. (700° F.).

The consolidated product, which may be hot worked, is solution treated and may also be given an age hardening treatment. The solution treatment is effected at a temperature of about 425° C. (795° F.) up to 570° C. (1050° F.), e.g. between about 450° C. (850° F.) up to about 565° C. (1050° F.), preferably from about 495° C. (925° F.) up to about 535° C. (1000° F.), typically about 495° C. (925° F.). The solution treatment is preferably below the degassing temperature to avoid possible blistering due to gas generation. The solution treatment conditions are generally in the range of about 480° C. to about 520° C. (895° F. to 970° F.), typically 495° C. (925° F.) for a sufficient amount of time to homogenize the alloy, i.e., to dissolve any precipitates or chemical gradients while retaining oxide and carbide dispersoids, typically the solution treatment is from 1 to 8 hours, e.g., about 2 hours. The solution treatment is followed by a rapid cooling, e.g. by water quench. The solution treated alloy is characterized by a small grain size, e.g., about 0.5 to about 1.5 μm.

In one preferred embodiment, the alloy is processed by aging to a condition below peak strength. This treatment increases strength and only with a slight reduction in toughness, and it avoids potential problems with the deleterious precipitation of the embrittling $\delta'$ phase. Aging is carried out a temperature of about 120° C. (245° F.) to about 210° C. (410° F.) for a sufficient time to age the alloy without achieving peak strength (or hardness). The aging time is dependent on the temperature and at lower temperatures the time may be up to 120 hours, typically at about 170° C. (340° F.), the aging time is less than 10 hours.

In order to give those skilled in the art a better understanding of the invention, the following illustrative data are given:

EXAMPLE 1

All mechanically alloyed powder was made in a production-scale attritor. The attriting process itself is subject to several variables which can affect the quality and uniformity of the powder. For a specific alloy composition, the attriting process can be systematically varied to identify a standard set of operating conditions which will repeatedly produce uniform, well attrited powder. However the attriting parameters were not optimized. The powder produced was judged to be sufficiently uniform for use as a first approximation in establishing the capability of a given alloy composition when produced by mechanical alloying. A selected alloy was attrited under more optimized conditions. All powder was made by the milling of elemental aluminum (0.03% Fe) and magnesium powder with an Al-Li master alloy (20% Li). The milling agent used was stearic acid and all milling was done under argon atmosphere. Seven billets were produced. Compositions of the seven billets and various properties of each billet are shown in Tables I through IV.

Table I shows the composition of the seven billets. Subsequent to the milling step, handling of the powder was in air, except for billet "G" which was stored under inert atmosphere and transferred to the consolidation die under inert atmosphere. All billets were consolidated by the vacuum hot pressing (VHP) process. Billet size was 0.28 m (11 in) diameter×0.86 m (34 in) length. For five compositions investigated the degassing/compaction temperature was 510° C. (950° F.), while additional experiments on two compositions (Billets F and G) utilized a temperature of 520° C. (970° F.). Pressing times and pressure conditions were comparable to those which would be used in the production of a 0.48 m (19 in) diameter billet.

TABLE I

ALLOY COMPOSITIONS

| Billet | Chemical Analysis Mg | Li | Fe | C | O* |
|---|---|---|---|---|---|
| A | 4.0 | 1.57 | .03 | 1.13 | .41 |
| B | 4.0 | 2.09 | .03 | 1.17 | .35 |
| C | 2.0 | 2.09 | .03 | 1.14 | .38 |
| D | 3.9 | 2.07 | .03 | 0.79 | .31 |
| E | 4.0 | 2.60 | .03 | 0.82 | .26 |
| F | 3.8 | 2.13 | .03 | 1.17 | .40 |
| G | 4.0 | 2.09 | .01 | 1.19 | .24 |

*Oxygen analysis by Leco Oxygen/Nitrogen Determinator (TC-30).

Table II lists the pressing temperatures and percent of full density obtained in each billet. Fabrication of the billets was by extrusion to 1 inch×4 inch rectangular cross-section. The extrusion temperature was a nominal 370° C. (700° F.), the measured temperatures spanning 363° C. (685° F.) min and 382° C. (720° F.) max.

TABLE II

BILLET DENSITY VS. COMPOSITION AND VHP TEMPERATURE

| Billet | VHP Temp. °C. | (°F.) | Apparent Billet Density (% of Full Density) |
|---|---|---|---|
| A | 510 | (950) | 98 |
| B | 510 | (950) | 98 |
| C | 510 | (950) | 96 |
| D | 510 | (950) | 95 |
| E | 510 | (950) | 97 |
| F | 521 | (970) | 98 |
| G | 521 | (970) | 98 |

EXAMPLE 2

Mechanical Properties: As Solution Treated

Sections from each extrusion were solution treated 2 hrs at 495° C. (925° F.) and water quenched. From these pieces duplicate longitudinal (L) and transverse (T) specimens were machined for tensile testing. For measuring fracture toughness ($K_Q$), compact tension specimens were prepared 51 mm (2 in) (W) by 22 mm (0.85 in) (B) in cross-section in the L-T orientation (W is the depth and B is the thickness of the specimen). Density ($\rho$) was also measured on the assolution treated samples. These properties are shown in Table III for the 5 alloys to compare compositions under equivalent compaction conditions. In Table III: $\rho$=density, YS=0.2% offset yield strength, UTS=ultimate tensile strength, El=elongation to failure, RA=reduction in cross-sectional area at failure, and $K_Q$=fracture toughness.

TABLE III

MECHANICAL PROPERTIES IN SOLUTION TREATED (925° F.) AND QUENCHED CONDITION

| Billet | $\rho$ (Mg/m$^3$) | Orient. | YS (ksi) | UTS (ksi) | El (%) | $K_Q$ (ksi/in) |
|---|---|---|---|---|---|---|
| A | 2.57 | L | 69.6 | 74.8 | 10 | 36 |
| | | T | 62.8 | 72.5 | 10 | |
| B | 2.54 | L | 70.4 | 79.6 | 10 | 20 |
| | | T | — | 74.8 | 4 | |
| C | 2.56 | L | 68.0 | 73.1 | 10 | 27 |
| | | T | — | 68.8 | 6 | |
| D | 2.53 | L | 64.3 | 71.9 | 13 | 30 |
| | | T | 61.6 | 69.9 | 9 | |
| | | T | 61.6 | 69.9 | 9 | |
| E | 2.50 | L | 61.4 | 76.3 | 8 | 42* |
| | | T | — | 68.8 | 3 | |

*Specimen approximately 10% thinner than specimens from other alloys.

Table III shows that all compositions had strengths in excess of those required to meet generally accepted 7075-T7 forging properties. Billet A had the greatest toughness of the four comparable specimens, while its yield strength was greater than or equal to that of the other four billets. However, the lower Li content of Billet A also made it the highest density alloy in the investigation. Billet C with reduced Mg and higher Li had comparable density and strength to Billet A but had decreased fracture toughness.

The effects of composition on strength shown in Table III were: (1) increased Li increased strength when dispersoid level is held constant (Billet B vs. Billet A); (2) decreased Mg decreased strength (Billet C vs. Billet B), and (3) decreasing dispersoid level decreased strength (Billet B vs. Billet D). Thus if increased Li is compensated for by reducing strength (through control of dispersoid level), density may be decreased while maintaining fracture toughness. Table III also shows that alloys with oxygen contents of 0.4% and even as low as 0.2% could be made which have low density and high strength and fracture toughness.

Table IV shows the effect of improved powder processing and modified compaction process on the properties of alloys having a nominal magnesium and lithium content of 4% Mg and 2% Li and an oxygen content of 0.2 to 0.4%.

TABLE IV

MECHANICAL PROPERTIES OF Al-4% Mg-1.2% Li-1.15% C-0.4% O AS AFFECTED BY VHP TEMPERATURE AND POWDER PROCESSING PARAMETERS

| Billet | VHP Temp. °C. | (°F.) | Orient. | YS (ksi) | UTS (ksi) | El (%) | RA (%) | $K_Q$ (ksi/in) |
|---|---|---|---|---|---|---|---|---|
| B | 510 | (950) | L | 70.4 | 79.6 | 10 | 10 | 20 |
| | | | T | — | 74.8 | 4 | 17 | — |
| F | 521 | (970) | L | 68.0 | 78.9 | 8 | 10 | 24 |
| | | | T | 62.0 | 75.2 | 7 | 8 | — |
| G | 521 | (970) | L | 67.2 | 77.8 | 10 | 14 | 27 |
| | | | T | 64.2 | 71.8 | 6 | 9 | — |

Similarly processed powders which were consolidated at different VHP temperatures (Billet B vs. Billet F) had comparable tensile properties; however, the increase in VHP temperature caused a significant increase in toughness. Similarly, improving powder processing parameters while maintaining constant VHP temperatures (Billet G vs. Billet F) maintained tensile properties, but also improved toughness. The improvement in toughness produced by the combination of both processes (Billet G vs. Billet B) is substantial. It is believed that similar treatment of specific compositions might improve the properties of the billets listed in Table III.

EXAMPLE 3

Mechanical Properties: Solution Treated, Quenched and Aged

Aging curves were developed for each of the alloys. From these curves a heat treatment was selected for each alloy with the objective of achieving 585 MPa (85 ksi) UTS without obtaining peak hardness. In several cases the tensile properties showed significant discrepancies from the values expected from the aging curves, and demonstrated that shorter aging time should have been selected. The properties of aged alloys are listed in Table V. Because of the extremely high strength and large strength differentials developed between alloys, no comparison of toughness was made.

TABLE V

MECHANICAL PROPERTIES SOLUTION TREATED IN 496° C. (925° F.), QUENCHED AND AGED CONDITION

| | VHP temp. | | Aging Time (h) | YS | UTS | El |
|---|---|---|---|---|---|---|
| Billet | °C. | (°F.) | at 124° C. (255° F.) | (ksi) | (ksi) | (%) |
| B | 510 | (950) | 6 | Brittle - No Test | | |
| F | 520 | (970) | 6 | 91.4 | 94.7 | 1.3 |
| G | 520 | (970) | 6 | 92.6 | 94.0 | 5 |
| C | 510 | (950) | 48 | 90.8 | 96.0 | 1 |
| D | 510 | (950) | 3 | 81.5 | 85.8 | 4.6 |
| E | 510 | (950) | ¾ | 82.5 | 84.4 | 4.2 |

Billet A is a non-aging composition and was thus not tested.

Billets B, F and G, all of the same composition, again demonstrate the benefit of optimizing processing variables. The "nominally processed" Billet B was too brittle to give a meaningful tensile test. Raising the pressing temperature to 520° C. (970° F.) (Billet F) improved ductility sufficiently to allow testing, and combining 520° C. (970° F.) VHP temperatures with improved powder processing (Billet G) produced a product with significant ductility for the strength level achieved.

When aged to a lower strength level, it is anticipated that adequate ductility can be developed to produce a useful alloy with 585 MPa (85 ksi) UTS and density reductions (compared to 7075) of 10–11%.

From the tests it was concluded:

1. In the solution treated (after quenching) condition, these alloys develop high strength with excellent ductility. This is attributed to the ability of the mechanical alloying process to increase the strength of Al-Mg-Li without precipitation hardening. Typical properties of an Al-4%Mg-2%Li-1.15%C-0.2-0.4%O alloy are 462 MPa (67 ksi) YS, 545 MPa (79 ksi) UTS, 10% El at a density of 2.54 $Mg/m^3$.

2. Variation of powder processing parameters and vacuum consolidation temperature was found to have a very significant effect on toughness, increasing $K_Q$ in a 22 mm (0.85 in) thick specimen from 21.8 (19.8) to 29.6 (26.9) MPa $\sqrt{m}$ (ksi $\sqrt{in}$) with tensile properties essentially unaffected at the 462 (67)–483 (70) MPa (ksi) YS level.

3. Strong aging response occurred in several alloys. Property levels of 559 MPa (81 ksi) YS, 593 MPa (86 ksi) UTS, 4.5% El, were achieved in an underaged alloy of Al-4%Mg-2%Li-0.8%C-0.3%O with a density of 2.53 $Mg/m^3$. The processing-compaction benefits noted in Conclusion 2 also apply to aged alloys and suggest that application of these to compositions aged to the 586 MPA (85 ksi) UTS level would develop alloys having an excellent combination of strength, ductility and toughness.

EXAMPLE IV

Aging Behavior

Various mechanically alloyed dispersion strengthened alloy compositions are prepared essentially as described above including degassing, in the range of 510° C. (950° F.) and 520° C. (970° F.) and extrusion at 370° C. (700° F.). The alloys are solution treated at temperatures in the range of 495° C. (925° F.) to 570° C. (1050° F.) for one hour and quenched in room temperature water. Samples of the solution treated alloys are naturally aged and artificially aged in a circulating air furnace at 125° C. (255° F.), 170° C. (340° F.), 190° C. (371° F.) and 210° C. (410° F.) for various times ranging up to 1000 hours. The compositions contain about 1.5 to about 2% Li and about 1 to about 4% magnesium. In general, for alloys containing 2%Li-4%Mg, maximum hardness occurs in about 1 to 4 hours at about 125° C. (255° F.) aging temperature. A typical aging study carried out on an alloy containing 1.5% Li, 4% Mg, 0.4% $O_2$ and 1.15% C, degassed at 510° C. (950° F.) extruded at 370° C. (700° F.), solution treated at 495° C. (925° F.) for 2 hours, water quenched, was aged at 170° C. (340° F.) for a period up to 48 hours. It was found that little aging took place until about 24 hours. In accordance with the present invention, aging if carried out was to under peak hardness, i.e., the alloys are underaged. At 30 hours peak hardness, the 1.5%-4%Mg alloy showed some evidence of δ' precipitation. After solution treatment of 2 hours at 495° C. (925° F.) and water quenching, the sample had a hardness of 81.9 Rockwell B. Hardness measurements after 1 days and 14 days, at room temperature, showed a hardness of 82.3 and 82.1, respectively, i.e., essentially no change.

The test demonstrating little change in hardness when the alloy remained at room temperature for 14 days showed that the alloy remains stable, i.e., it has little tendency to undergo further aging at room temperature.

EXAMPLE V

Metallography

Metallographic examination of mechanically alloyed Al-Li-Mg powders having compositions within the scope of the present invention show that the powders are spheroidal in shape and have a homogeneous, well alloyed microstructure. The surface of the powder particles is devoid of surface contamination such as surface hydrated oxides, which, if present, may degrade the properties of the alloy.

A sample of mechanically alloyed Al-1.5Li-4Mg containing about 5.4% dispersoid was outgassed at 510° C. (950° F.) and extruded at 370° C. (700° F.), metallographically mounted and examined in the as-polished and etched 10% NaOH condition. It was found to have had extremely fine grain structure that could not be resolved by optical metallography at magnifications up to 1000x. The microstructure is very clean and homogenous. Observations at higher magnifications via electron microscopy reveal the grain structure to vary from about 0.3 to about 2 micrometers for an average of about 0.75 micrometers. The grains are slightly elongated in the extrusion direction for an average length to diameter ratio of 1.3. The dispersoids, e.g. oxides and carbides, are homogeneously distributed through the matrix and range in size from 20 to 30 nm, with the oxides slightly larger than carbides. Evidence of $\delta'$ ($Al_3Li$) superlattice reflections indexed by electron diffraction show that $\delta'$ is present in the as-extruded alloy even though the precipitates are too small to be specifically identified.

While in accordance with the provisions of the statute there is illustrated and described herein specific embodiments of the invention, those skilled in the art will understand that changes may be made in the form of the invention covered by the claims and that certain features of the invention may sometimes be used to advantage without a corresponding use of the other features. In the foregoing description and the appended claims various values for data are given in English and SI units. The values as measured for tensile and other mechanical data were obtained in English units, whereas density temperatures and other values were obtained in SI units. Appropriate conversions were then made. If any discrepancy exists, the values as measured shall take precedence over the value as converted.

The embodiments of the invention in which an exclusive property or privilege is claimed are defined as follows:

1. A process for producing a dispersion strengthened aluminum-base alloy comprising: (a) providing a mechanically alloyed dispersion strengthened powder consisting essentially, by weight, of about 0.5% to about 4% lithium, above 1% up to about 5% magnesium, a small but effective amount for increased strength up to about 2% carbon, a small but effective amount for thermal stability up to 1% oxygen, and the balance, essentially aluminum, the dispersoid content of the alloy being present up to about 8 volume %; (b) degassing and consolidating the mechanically alloyed powder at a temperature in the range of about 480° C. to a temperature below incipient liquification; (c) solution treating the consolidated alloy at a temperature of about 425° C. to about 570° C., whereby the alloy in the solution treated condition has a YS of at least 414 MPa, elongation of at least about 7%, and fracture toughness ($K_Q$) at 22 mm B of at least about 16.5 MPa $\sqrt{m}$.

2. A process of claim 1, wherein the solution treated alloy is subjected to an aging treatment to below peak strength.

3. A process of claim 1, wherein degassing is effected at a temperature between about 510° C. to about 540° C.

4. A process of claim 1, wherein solution treatment is effected at about 480° C. to about 520° C. for a period of about 1 to 4 hours.

5. A process of claim 1, wherein aging treatment is effected at about 120° C. to 210° C. for about 1 hour to 10 hours.

6. A process of claim 1, wherein in the degassed, consolidated alloy the lithium content is above 1.5% and the oxygen content does not exceed about 0.5%.

7. A process of claim 6, wherein the oxygen content of the degassed, consolidated alloy is about 0.2 to about 0.4%.

8. A process of claim 6, wherein the oxygen content of the degassed, consolidated alloy is less than 0.4%.

9. A process of claim 1, wherein the lithium content of the degassed, consolidated alloy is about 1% to about 3%.

10. A process of claim 1, wherein the lithium content of the degassed, consolidated alloy is about 1.5% to about 2.5%.

11. A process of claim 1, wherein the magnesium content of the degassed, consolidated alloy is about 2% to about 4.5%.

12. A process of claim 1, wherein the carbon content of the degassed, consolidated alloy is about 0.5% to about 2%.

13. A process of claim 1, wherein the carbon content of the degassed, consolidated alloy is about 0.8% to about 1.2%.

14. A mechanically alloyed dispersion strengthened aluminum base alloy produced by the method of claim 1.

15. A mechanically alloyed dispersion strengthened aluminum-base alloy in the solution treated and underaged condition consisting essentially of about 1.5 to about 2.5% lithium, about 2% up to about 4.5% magnesium, about 0.7 to about 1.2% carbon and a small but effective amount for increased stability up to 1% oxygen.

16. An alloy of claim 15, wherein the oxygen content is less than 0.5%.

17. An alloy of claim 15, wherein the oxygen content is between about 0.2% and about 0.4%.

18. An alloy of claim 15, wherein the ratio of carbon to oxygen is at least 2 to 1.

19. An alloy of claim 15, wherein the ratio of carbon to oxygen is greater than about 2.5 to 1.

20. A mechanically alloyed dispersion strengthened aluminum-base alloy in the solution treated condition consisting essentially of about 1.5 to about 2.5% lithium, about 2% up to about 4.5% magnesium, about 0.7 to about 1.2% carbon and a small but effective amount for increased stability up to 1% oxygen.

21. An alloy of claim 20, wherein the oxygen content is less than 0.5%.

22. An alloy of claim 20, wherein the oxygen content is between about 0.2% and about 0.4%.

23. An alloy of claim 20, wherein the ratio of carbon to oxygen is at least 2 to 1.

24. An alloy of claim 20, wherein the ratio of carbon to oxygen is at least 2.5 to 1.

25. A process for producing a dispersion strengthened aluminum-base alloy comprising: (a) providing a mechanically alloyed dispersion strengthened powder consisting essentially, by weight, of about 0.5% to about 4% lithium, above 1% up to about 5% magnesium, a small but effective amount for increased strength up to about 2% carbon, a small but effective amount for thermal stability up to 1% oxygen, and the balance, essentially aluminum, the dispersoid content of the alloy being present up to about 8 volume %; (b) degassing and consolidating the mechanically alloyed powder at a temperature in the range of about 480° C. to a temperature below incipient liquification; and degassed and consolidated alloy having a carbon level exceeding the oxygen level and (c) solution treating the consolidated alloy at a temperature of about 425° C. to about 570° C., whereby the alloy in the solution treated condition has a YS of at least 414 MPa, elongation of at least about 7%, and fracture toughness ($K_Q$) at 22 mm B of at least about 16.5 MPa, $\sqrt{m}$.

26. A process of claim 25, wherein the oxygen content of the degassed, consolidated alloy does not exceed about 0.5%.

27. A process of claim 25, wherein the oxygen content of the degassed, consolidated alloy is about 0.2% to about 0.4%.

28. A process of claim 25, wherein the carbon content of the degassed, consolidated alloy is about 0.5% to about 2%.

29. A process of claim 25, wherein the magnesium content of the degassed, consolidated alloy is about 2% to about 4.5%.

30. A mechanically alloyed dispersion strengthened aluminum-base alloy consisting essentially of about 1.5% to about 2.5% lithium, about 2% up to about 4.5% magnesium, about 0.7% up to about 1.2% carbon, a small but effective amount for increased stability up to about 1% oxygen, said carbon level exceeding the oxygen level and said alloy having in the solution treated condition a YS of at least 414 MPa, elongation of at least about 7%, and fracture toughness ($K_Q$) at 22 mm B of at least about 16.5 MPa $\sqrt{m}$.

* * * * *